US009951565B2

(12) United States Patent
Taylor

(10) Patent No.: US 9,951,565 B2
(45) Date of Patent: Apr. 24, 2018

(54) REAMER WITH POLYCRYSTALLINE DIAMOND COMPACT INSERTS

(71) Applicant: Todd Taylor, Benton, IL (US)

(72) Inventor: Todd Taylor, Benton, IL (US)

( * ) Notice: Subject to any disclaimer, the term of this patent is extended or adjusted under 35 U.S.C. 154(b) by 191 days.

(21) Appl. No.: 15/048,501

(22) Filed: Feb. 19, 2016

(65) Prior Publication Data

US 2017/0241210 A1 Aug. 24, 2017

(51) Int. Cl.
*E21B 10/46* (2006.01)
*E21B 10/26* (2006.01)

(52) U.S. Cl.
CPC ..... *E21B 10/46* (2013.01); *E21B 10/26* (2013.01)

(58) Field of Classification Search
CPC ..... E21B 10/26; E21B 10/46
See application file for complete search history.

(56) References Cited

U.S. PATENT DOCUMENTS 4,618,010 A * 10/1986 Falgout, Sr. ..... E21B 10/26 175/385
4,765,417 A * 8/1988 Perkin ..... E21B 10/22 175/347
5,678,644 A * 10/1997 Fielder ..... E21B 10/26 175/391
7,111,694 B2 * 9/2006 Beaton ..... E21B 10/26 175/406

* cited by examiner

*Primary Examiner* — Giovanna C. Wright
*Assistant Examiner* — Jonathan Malikasim
(74) *Attorney, Agent, or Firm* — Gary K. Price

(57) ABSTRACT

A reamer device that uses polycrystalline diamond compact (PDC) cutting elements mounted to the reamer blades. The device includes a body that defines a cutting face, a gage region and an extended end, and includes multiple blades disposed along the gage region of the body. Each of the multiple blades multiple planar surfaces, and a plurality of cutting elements positioned along the length of each of the multiple blades. The cutting elements disposed along second and third planar surfaces of each blade being slightly offset from the other blades such that in application the rotating multiple blades cause an upwardly spiraling effect.

20 Claims, 5 Drawing Sheets

REAMER WITH POLYCRYSTALLINE DIAMOND COMPACT INSERTS

CROSS REFERENCES TO RELATED APPLICATIONS

U.S. Provisional Application for Patent No. 62/129,506, filed Mar. 6, 2015, with title "Reamer with Polycrystalline Diamond Compact Inserts" which is hereby incorporated by reference. Applicant claims priority pursuant to 35 U.S.C. Par. 119(e)(i).

STATEMENTS AS TO RIGHTS TO INVENTIONS MADE UNDER FEDERALLY SPONSORED RESEARCH AND DEVELOPMENT

Not Applicable.

BACKGROUND OF THE INVENTION

1. Field of the Invention

The present invention is generally related to drilling methods, and more particularly, to drilling methods and devices used in drilling. More particularly, this application relates to a reamer device for using polycrystalline diamond compact (PDC), in reamers and other drilling equipment.

2. Brief Description of Prior Art

Many drilling processes for drilling wells for oil and gas production are currently known and used. Methods and devices for using polycrystalline diamond compact (PDC) inserts in reamers, and other drilling equipment used in drilling are similarly known.

The PDC drilling relevant to the present invention is generally set up with PDC cutters mounted to blades. Many methods for defining the setting patterns for such PDC cutters are known in the art. The goals to be achieved with respect to any PDC cutter pattern include: enhancing the force balancing of the reamer; improving the cleaning of the face; evening out the wear of the cutters across the face; and, improving the durability of the reamer.

While the prior art patterns and methods for setting the locations of PDC cutters provide drill equipment with satisfactory performance, it is nonetheless recognized that there is room for improvement, especially in connection with providing a reamer having better performance ability. The present invention proposes a pattern and method for setting the locations of PDC cutters in drilling equipment that provides for improved cutting and durability.

SUMMARY OF THE INVENTION

The preferred embodiment is directed to a reamer device that uses polycrystalline diamond compact (PDC) cutting elements mounted to the reamer blades. The PDC device generally defines a multiple blade design having a plurality of PDC cutting elements set along the length of each of the blades. The device body includes a cutting face, a gage region and an extended end. Each of the blades are disposed at the cutting face region, and extend through the gage region and end at the extended end.

Each of the blades define a first slanted top surface that is approximately parallel with a first slanted surface of the device body. The blade further defines a second top surface that includes a first planar surface having a first height, a shoulder, and a second planar surface having a second height. The blade further defines a third top surface that is approximately parallel with a third slanted surface of the device body.

A plurality of cutting elements are positioned along the length of each of the blades. The first slanted top surface may include round-shaped PDC cutters set in a staggered pattern with rows of cutters offset in a lateral direction from adjacent rows, to provide full coverage of the first slanted top surface. The first planar surface similarly includes round-shaped PDC cutters in a staggered pattern with rows of cutters offset in a lateral direction from adjacent rows, to provide full coverage of the first planar surface. The second planar surface preferably includes substantially round-shaped PDC cutters in a linear, tracking pattern, one behind another in a row in the direction of reamer rotation. Similarly, the third slanted top surface includes substantially round-shaped PDC cutters in a linear, tracking pattern, one behind another in a row in the direction of reamer rotation.

DESCRIPTION OF THE PREFERRED EMBODIMENT

The present invention is directed to drilling equipment that use polycrystalline diamond compact (PDC) cutting elements mounted to blades. The present PDC device generally defines a multiple blade design having a plurality of PDC cutting elements set along the length of each of the blades. The multiple blades having the plurality of PDC cutting elements effectively form the cutting face of the device. In the broadest context, the PDC cutting device of the present invention consists of components configured and correlated with respect to each other so as to attain the desired objective.

Figure 3:
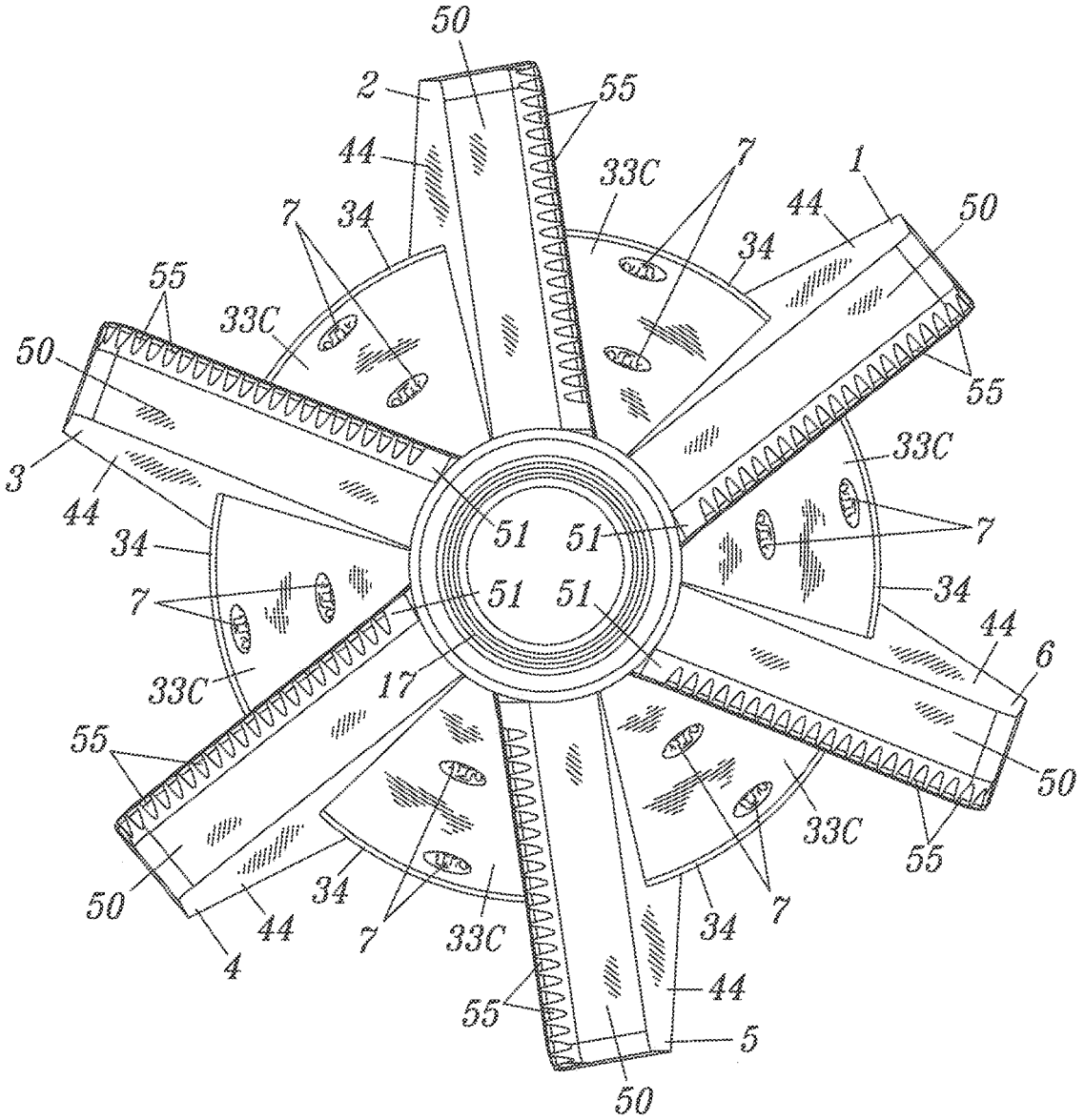
FIG. 3 is a first end end view of the reamer shown in FIG. 1.
Figure 4:
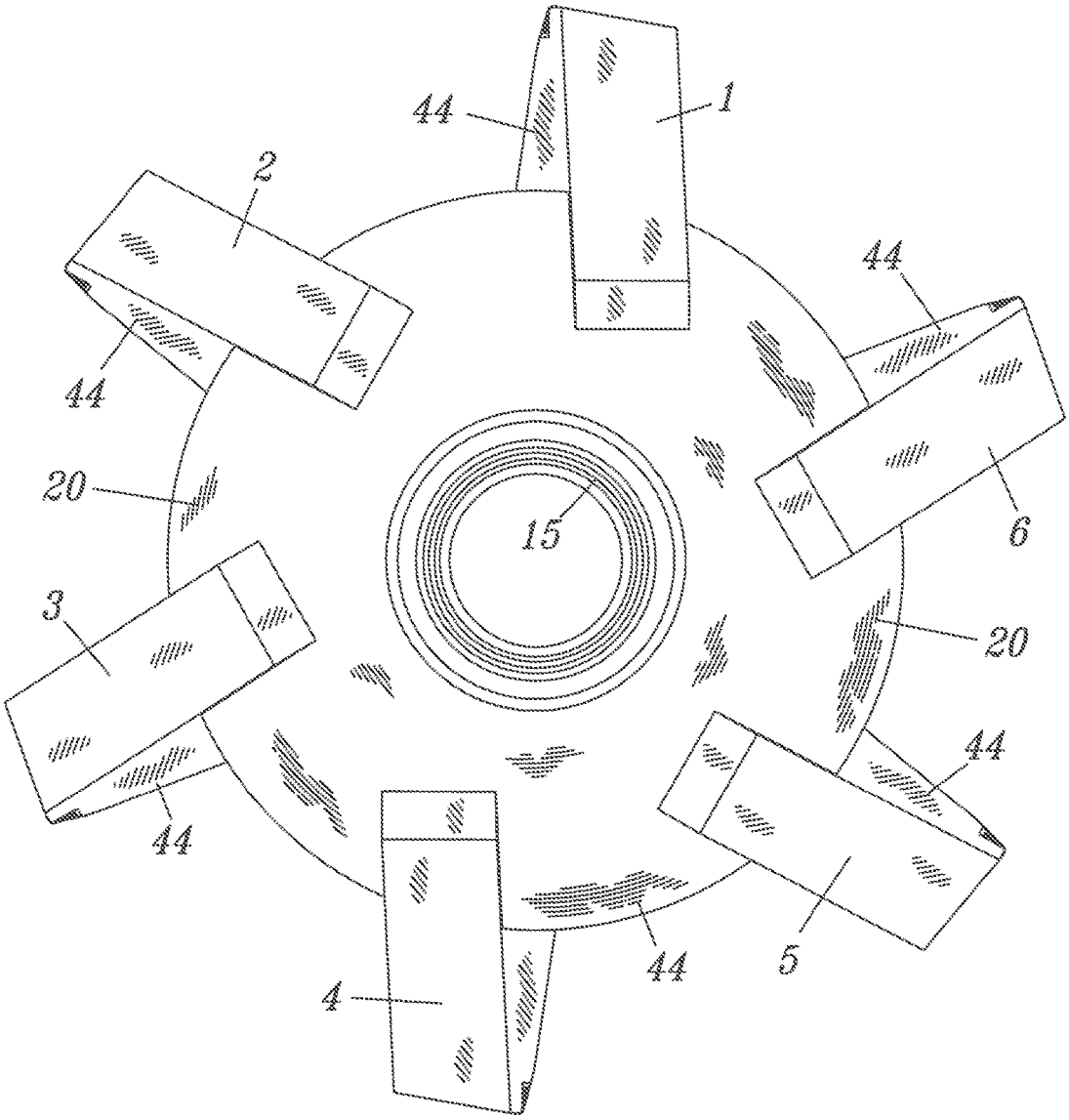
FIG. 4 is an opposite end view of the reamer shown in FIG. 1.

According to embodiments of the present invention, the device designated as numeral 10 includes a reamer body 12 having a longitudinal axis 14 extending axially therethrough (see FIG. 3). The body 12 includes a first connector 15 and a second connector 17. The first connector 15 and second connector 17 of the device 10 can be threaded connectors for threaded coupling with different components in a drilling operation.

As illustrated, the first and second connectors 15, 17 can each be a female thread that can work cooperatively with a male thread of a drilling component to couple the device 10 to a section of the drilling component. Similarly, the first and second connectors 15, 17 can be a male thread that can work cooperatively with a female thread of a drilling component to couple the device to that section of the drilling component.

In the illustrations, blades 1, 2, 3, 4, 5 and 6 comprise the multiple blades of the device 10. Each of the blades are similarly constructed having the same embodiments. As such, only the elements on the first blade 1 will be described, it being understood that the other multiple blades, blades 2, 3, 4, 5 and 6 in the drawings, are substantially identical except as will be discussed, and disclosed in FIG. 5. Further, while the device illustrated includes six (6) blades, it should be understood the device may be constructed with less or more blades all having the same embodiments as will be disclosed.

For purposes of illustration, the reamer body 12 can be described as including an upper face 20, a gage region 25 and an extended end 30 that is adjacent the second connector 17. The extended end 30 opposite from the upper face 20 which is adjacent the first connector 15.

The upper face 20 refers to the area of the cutting device 10 substantially facing in the opposite direction of reaming. The gage region 25 of the device 10 having a generally conical or bullet-shaped gage region 25, may cut or maintain the gage, or outer diameter of the wellbore being reamed, and thus may engage a sidewall of the wellbore.

The cutting device 10 includes multiple blades that as will be explained, each continue from the upper face 20 region, and extend through the gage region 25 and end at the extended end 30.

The gage region 25 of the body 12 has a substantially cylindrical configuration from which the multiple blades radially extend. As illustrated, the substantially cylindrical region does not account for the blades themselves but just considers the body structure from which the blades extend. However, as will be described, a critical feature of the present device is how each of the blades similarly extend the length of the device 10 and generally follows the conical-shaped body structure or outline of the body 12.

Figure 1:
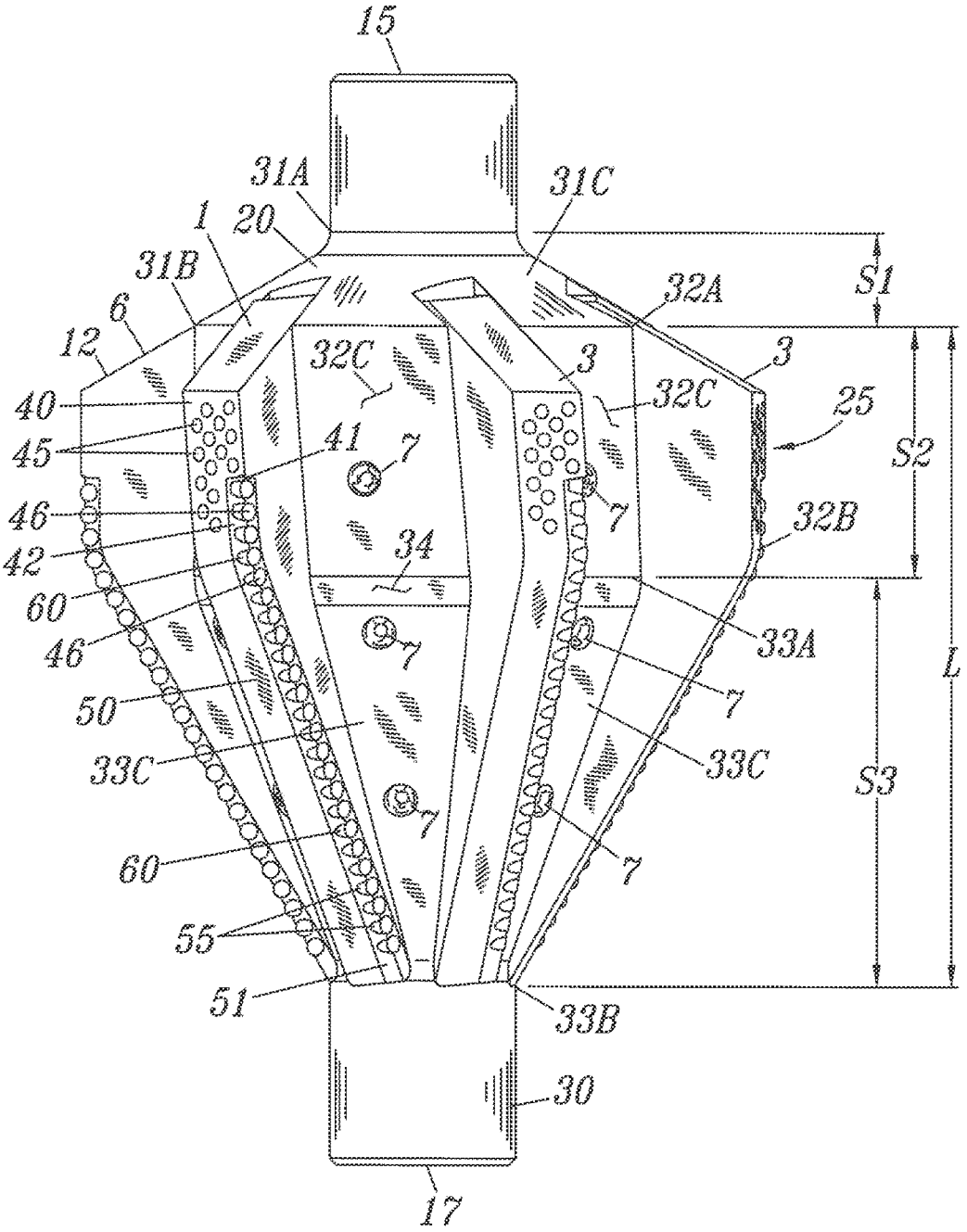
FIG. 1 is a side view of the present invention, a reamer with polycrystalline diamond compact inserts.
Figure 2:
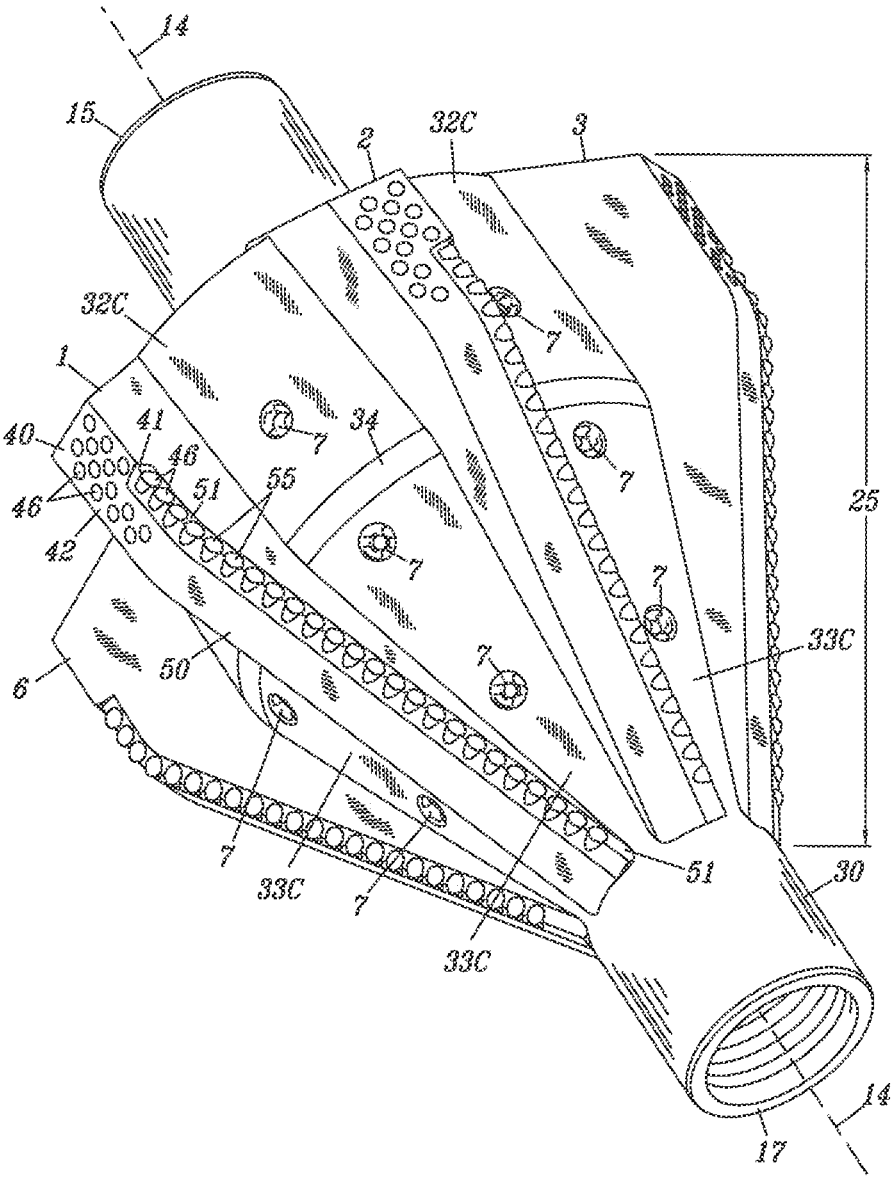
FIG. 2 is a perspective view of the device shown in FIG. 1, and further illustrates the second connector of the reamer body.

The body structure of the reamer body 12, for purposes of illustration (see FIG. 1), are divided in a first section "S1" that includes the upper face 20 region, a second section "S2" that generally defines the upper portion of the gage region 25, and a third section "S3" that includes the remaining portion of the gage region 25 and extends to the extended end 30.

The first section S1 defines a first end 31A and a second end 31B. As shown, the body 12 of the first section S1 defines a sloped area 31C. Accordingly, the first end 31A has a circumference that is less than the circumference at point 31B that generally defines the sloped surface 31C. The first section S1 surface being sloped from the first end 31A to the second end 31B.

The second section S2 defines a first end 32A (adjacent the second end 31B of the first section S1) and a second end 32B. More particularly, the second section S2 defines a generally planar surface 32C.

The third section S3 defines a first end 33A (adjacent the second end 32B of the second section S2) and a second end 33B, with a distinct shoulder 34 at the junction of sections S2 and S3. As illustrated, the first end 33A has a circumference that is greater than the circumference at point 33B such that the third section S3 defines a sloped surface 33C that generally extends from point 33A to point 33B. The third section S3 being downwardly sloped from the first end 33A to the second end 33B.

The reamer body 12 further includes a plurality of blow holes 7. More particularly, the reamer body 12 includes a blow hole 7 in the second and third sections S2 and S3, respectively, of the body 12 and disposed between each of the multiple blades.

As described, the reamer body 12 transitions uniformly from the cutting face 20 to the extended end 30 by a radiused, curved, angled or other shaped transition.

The multiple blades are similarly disposed. In particular, each of the blades extend the approximate length L of the gage region 25 (sections S1 and S2) of the reamer body 12 and generally follow the orientation of the surfaces 32C, 33C. Each of the blades can be integral to the body 12, or physically attached and separated from the body 12 with, for example, bolts (not shown).

Referring to blade 1, as illustrated, the blade generally extends from point 32A to point 33B (sections S2 and S3) of the reamer body 12. However, it is also within the scope of the present disclosure that the blades may extend into the upper face (first section S1).

In the second section S2, the blade 1 defines a first planar surface 40 that extends the approximate length of section S2. The first planar surface 40 further includes a shoulder portion 41 that junctions with a second planar surface 42 that defines a portion of the first planar surface 40. The second planar surface 42 extending from the shoulder 41 to the defined end 32B of the second section S2.

As illustrated, the upper end of the blade is approximately adjacent to point 32A and includes a wall 44 that is radiused or otherwise transitioned from the base of the blade (the reamer body) to point 33B adjacent the extended end 30. For example, the blade 1 may include a sloped and/or substantially perpendicular wall extending the reamer body 12 from point 32A to point 33B. The portion of the blade in section S2 (upper end) having a first height or distance between the blade's surface 40 and planar surface 32C of the body. The selected portion of the blade in section S3 (lower end) having a second height or distance between the blade's surface 50 and planar surface 33C of the body such that, as already described, each blade defines a sloped wall that is perpendicular to the reamer body 12.

The first planar surface 40 includes round-shaped PDC cutters 45 in a staggered pattern with rows of cutters offset in a lateral direction from adjacent rows. The defined second planar surface 42 preferably includes substantially round-shaped PDC cutters 46 in a linear, tracking pattern, one behind another in a row in the direction of reamer rotation.

The blade further defines a third planar surface 50 that extends from point 33A to point 33B. The third planar surface 50 defines an edge 51 that extends the length of the third planar surface. The edge 51 being sized and shaped like the second planar surface 42, and is configured as a continuation of the second planar surface 42 defined in the second section S2. The edge 51 preferably includes substantially round-shaped PDC cutters 55 in a linear, tracking pattern, one behind another in a row in the direction of reamer rotation.

Figure 5:
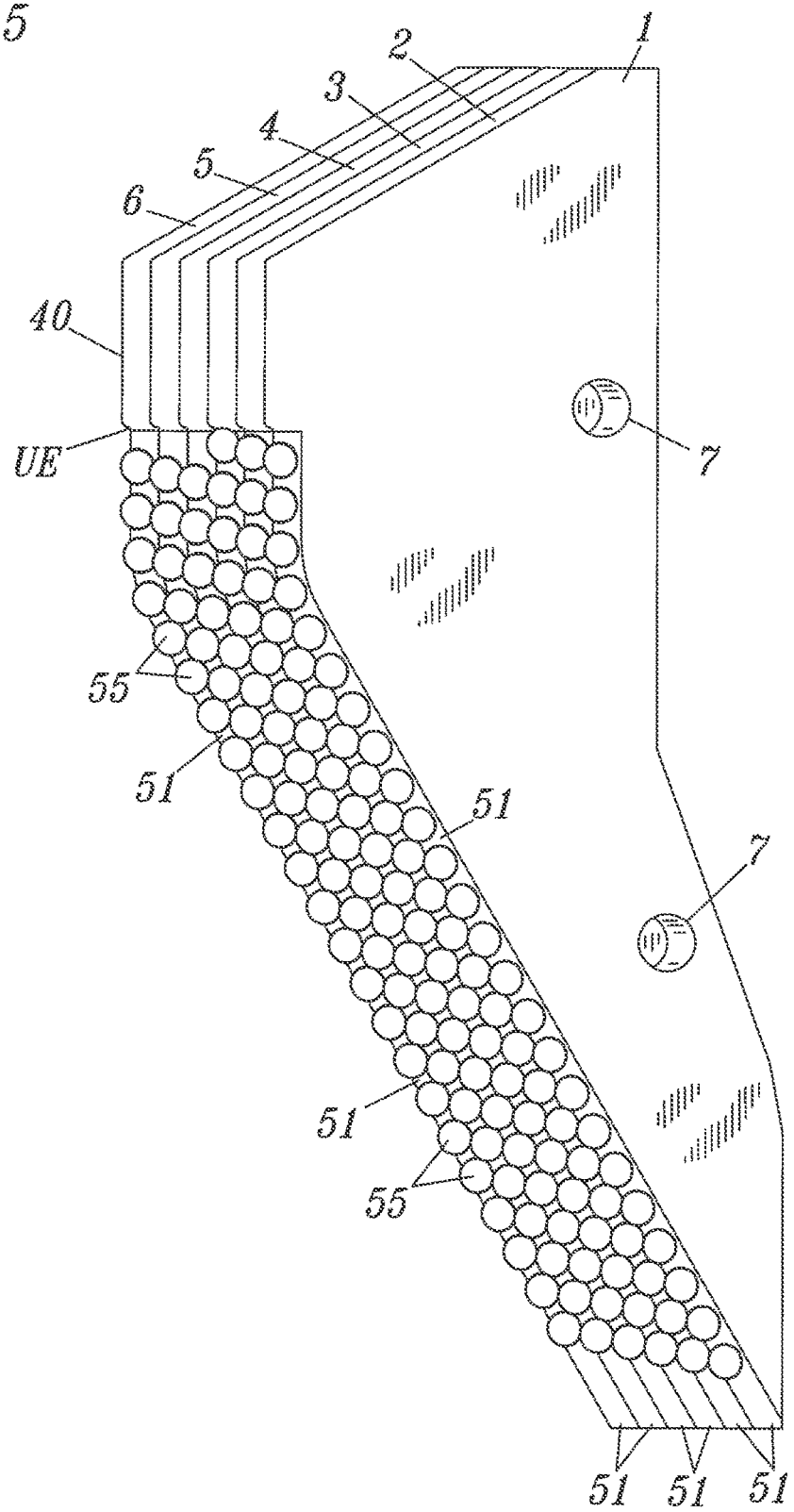
FIG. 5 is an illustration to show placement of the cutting elements along the second planar surface and third planar surface edge for each of the multiple blades.

FIG. 5 is an illustration that focuses on the gage region 25 for each of the blades 1, 2, 3,4,5,6, and particularly shows the edge 51 on each of the blades in a side-by-side orientation in order to better see the positioning of the cutting elements 55 on each of the blades.

As illustrated the cutting elements 55 on each blade is slightly offset from the cutting elements on the adjacent blade, such that the elements 55 on blade 1 are not in line with the cutting elements 55 on blade 2, and blade 2 cutting elements are similarly not in line with the cutting elements on blade 3 and so on.

In the preferred embodiment, each row of cutters are shifted approximately 150 thousands of an inch toward the upper end "UE" which is adjacent the first planar surface 40. With this orientation, during application, the cutting elements 55 of the rotating blades appear to continuously spiral up to the approximate upper face 20 of the body 12. The Applicant has found this spiraling effect results in a more efficient drilling.

Each blade therefore includes an area that is defined by the second planar surface 42 and the edge 51 that includes a continuous row of round-shaped PDC cutters (cutters 46 and 55) one behind another in the direction of reamer rotation.

As generally described, a plurality of cutting elements 45, 46 and 55 are positioned on each of the surfaces 40, 42 and 50 of the blades. The cutting elements can be made in a variety of shapes and configurations. For example, the PDC cutters 45 can be round, square, rectangular or any other geometric configuration. Similarly, the cutters 46 and 55 can be of any geometric configuration as well. The PDC cutters can further have any size corresponding with the length, diameter, and wall thickness of the reamer device 10.

Generally, the cutting elements preferred in the present invention have either a round shape or, in some instances, a more elongated, substantially round shape. The cutting elements commonly comprise of a super abrasive material, commonly referred to as "polycrystalline diamond compact" (PDC) cutting elements or cutters. The plurality of PDC cutting elements may be provided within cutting element pockets generally designated 60 formed in rotationally leading surfaces of each of the multiple blades.

As illustrated, the first planar surface 40 includes round-shaped PDC cutters 45 set in a staggered pattern with rows offset in a lateral direction from adjacent rows, to provide full coverage of the first planar surface 40.

The second planar surface 42 includes round-shaped PDC cutters 46 provided within cutting element pockets 60 in a linear, tracking pattern, one behind another in a row in the direction of reamer rotation. Similarly, the third planar surface 50, and more particularly edge 51 of surface 50, includes substantially round-shaped PDC cutters 55 provided within cutting element pockets 60 in a linear, tracking pattern, one behind another in a row in the direction of reamer rotation.

As such, the plurality of cutting elements extend the length L of the multiple blades extending from the approximate upper face 20 along the gage region 25 to the extended end 30 in the various patterns described. It is now further understood that each of the PDC cutters provided on each of the multiple blades as disclosed, are positioned at a same radial distance from the axis 14 of the reamer body 12 as corresponding ones of the PDC cutters on blade 1.

The PDC cutters may be substantially flush with the surface as with the cutters provided on the first planar surface 40, or the PDC cutters may be exposed as depicted on the surfaces 42 and 50 in order to enhance the reamer action.

Although the above description contains many specificities, these should not be construed as limiting the scope of the invention but as merely providing illustrations of some of the presently preferred embodiments of this invention. As such, it is to be understood that the present invention is not limited to the embodiments described above, but encompasses any and all embodiments within the scope of the claims.

It would be obvious to those skilled in the art that modifications may be made to the embodiments described above without departing from the scope of the present invention. Thus the scope of the invention should be determined by the appended claims in the formal application and their legal equivalents, rather than by the examples given.

I claim:

1. A reamer device used in drilling that uses polycrystalline diamond compact (PDC) cutting elements comprising:

a reamer body having a conical shape, said body defining a gage region that extends between an upper face disposed at an upper most end of said reamer body and an extended end disposed at a lower most end of said reamer body, said gage region includes an upper end and a lower end that defines a length, and wherein said upper end has a circumference that is greater than a circumference of said lower end such that said gage region defines a downward slope from said upper end to said lower end, multiple blades that each extend the length of said gage region, and wherein each of said multiple blades follow said downward slope of said gage region, and wherein an upper most portion of each of said blades includes PDC cutters disposed in a staggered pattern and a remaining length of said blades include PDC cutters disposed one behind another in a row, and wherein said row of cutters on each of said multiple blades is offset from the row of cutters disposed on the adjacent blade such that when the multiple blades rotate said row of cutters appear to continuously spiral in an upward direction.

2. The reamer device as recited in claim 1, wherein said reamer body further includes a first connector that is adjacent said upper face and a second connector that is adjacent said extended end.

3. The reamer device as recited in claim 2, wherein each of said blades extend into said upper face.

4. The reamer device as recited in claim 1, wherein said PDC cutters are within cutting element pockets.

5. The reamer device as recited in claim 1, said gage region further including a plurality of blow holes positioned between the multiple blades.

6. The reamer device as recited in claim 1, wherein each of said multiple blades are integral to said reamer body.

7. The reamer device as recited in claim 1, wherein each of said multiple blades are releasably attached to said reamer body.

8. The reamer device as recited in claim 1, wherein each of said multiple blades include a sloped wall that extends the length of the blade and is perpendicular to said reamer body.

9. The reamer device as recited in claim 1, wherein said offset is approximately 150 thousands of an inch.

10. A reamer device used in drilling that uses polycrystalline diamond compact (PDC) cutting elements comprising:

a reamer body having a conical shape structure, said body defining a gage region that extends between an upper face disposed at an upper end of said reamer body and an extended end disposed at a lower end of said reamer body, said gage region includes an upper end and a lower end, and wherein said gage region's upper end has a circumference that is greater than a circumference of said gage region's lower end such that said gage region generally defines a slope that downwardly extends from said gage region's upper end to said gage region's lower end, a first blade and a second blade, wherein each of said first and second blades extend the length of said gage region and follow said conical shape structure and said downward slope of said gage region, and wherein said first blade includes a first row of PDC cutters disposed one behind another, and wherein said first row of cutters extend the first blade's length, and said second blade includes a second row of PDC cutters disposed one behind another, and wherein said second row of cutters extend the second blade's length, and wherein said second row of cutters is offset a distance from said first row of cutters.

11. The reamer device as recited in claim 10, wherein said offset is towards the gage region's upper end.

12. The reamer device as recited in claim 11, wherein said distance is approximately 150 thousands of an inch.

13. The reamer device as recited in claim 12, wherein said reamer body further includes a first connector that abuts said upper face and a second connector that abuts said extended end.

14. The reamer device as recited in claim 13, further including a plurality of blow holes positioned between said first and second blades.

15. The reamer device as recited in claim 14, wherein said first and second blades each include a sloped wall that extends the length of each blade and is perpendicular to said reamer body.

16. A reamer device used in drilling that uses polycrystalline diamond compact (PDC) cutting elements comprising:

a reamer body having a conical shape structure and a gage region that extends between an upper face disposed at an upper end of said reamer body and an extended end disposed at a lower end of said reamer body and wherein said gage region having a length, multiple blades that each extend said length and follow the conical shape structure of said reamer body, wherein said reamer body further defines a first section having a first end and a second end and wherein said first end has a circumference that is less than a circumference of said second end such that said first section is sloped from the first end to the second end, and said reamer body further defines a second section having a first end that is adjacent the second end of said first section, said second section having a second end, and wherein said reamer body further defines a third section having a first end that is adjacent the second end of the second section, said third section having a second end, and a shoulder at the junction of said second section and said third section, and where the first end of said third section has a circumference that is greater than a circumference of the third section's second end such that said third section is downwardly sloped from its first end to its second end, each of said blades define a first planar surface that approximately extends from said first end of said second section to a shoulder portion disposed at said second end of said second section, and said shoulder portion junctions with a second planar surface that abuts a lower portion of the first planar surface, said second planar surface defines a width and extends from said shoulder portion to the second end of said second section, and wherein said first planar surface includes PDC cutters disposed in a staggered pattern, and said second planar surface includes PDC cutters disposed one behind another in a row, said blade further includes a third planar surface that extends from said first end of said third section to said second end of said third section, said third planar surface including an edge that extends the length of the third planar surface, and wherein said edge being of same width as the second planar surface and configured as a continuation of the second planar surface, said edge includes PDC cutters disposed one behind another in a row, and wherein said row of cutters that extend along said second and third planar surfaces on each of said multiple blades is offset from the row of cutters disposed on the second and third planar surfaces on the adjacent blade such that when the multiple blades rotate said row of cutters appear to continuously spiral from the second end of the third section to the first end of the second section.

17. The reamer device as recited in claim 16, wherein said reamer body further includes a first connector that abuts said upper face, and a second connector that abuts said extended end.

18. The reamer device as recited in claim 16, wherein said offset is approximately 150 thousands of an inch.

19. The reamer device as recited in claim 16, further including a plurality of blow holes positioned between said multiple blades.

20. The reamer device as recited in claim 16, wherein each of said multiple blades include a sloped wall that extends the length and is perpendicular to said reamer body.

* * * * *